US008144062B2

(12) United States Patent
Ke et al.

(10) Patent No.: US 8,144,062 B2
(45) Date of Patent: Mar. 27, 2012

(54) MULTI-BAND ANTENNA

(75) Inventors: Yun-Lung Ke, Tu-cheng (TW); Chen-Ta Hung, Tu-cheng (TW); Shu-Yean Wang, Tu-cheng (TW); Chun-Ming Chiu, Tu-cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 676 days.

(21) Appl. No.: 12/313,951

(22) Filed: Nov. 26, 2008

(65) Prior Publication Data

US 2009/0135072 A1 May 28, 2009

(30) Foreign Application Priority Data

Nov. 26, 2007 (TW) ..... 96144716 A

(51) Int. Cl.
*H01Q 1/24* (2006.01)

(52) U.S. Cl. ..... 343/702; 343/700 MS; 343/825; 343/826

(58) Field of Classification Search ..... 343/700 MS, 343/702, 825, 826
See application file for complete search history.

(56) References Cited

U.S. PATENT DOCUMENTS 6,714,162 B1 * 3/2004 Kadambi et al. ..... 343/700 MS
6,897,810 B2 * 5/2005 Dai et al. ..... 343/700 MS
7,289,071 B2 10/2007 Hung et al.
7,495,630 B2 * 2/2009 Hu et al. ..... 343/846
7,535,422 B2 * 5/2009 Liu et al. ..... 343/702
7,671,810 B2 * 3/2010 Yu ..... 343/702
7,705,784 B2 * 4/2010 Lai et al. ..... 343/700 MS
7,728,776 B2 * 6/2010 Lin et al. ..... 343/702
7,825,859 B2 * 11/2010 Teshima ..... 343/700 MS
7,893,877 B2 * 2/2011 Wang et al. ..... 343/700 MS
2007/0040750 A1 * 2/2007 Tai et al. ..... 343/700 MS
2007/0040754 A1 2/2007 Liu et al.
2007/0060222 A1 3/2007 Finn et al.
2007/0096999 A1 5/2007 Wang et al.

* cited by examiner

*Primary Examiner* — Jacob Y Choi
*Assistant Examiner* — Shawn Buchanan
(74) *Attorney, Agent, or Firm* — Wei Te Chung; Andrew C. Cheng; Ming Chieh Chang

(57) ABSTRACT

A multi-band antenna includes a grounding portion (300), a number of radiating members and a short-circuit portion (200). The short-circuit portion comprises a first short-circuit piece (210) connecting with the grounding portion and located in a first plane, a third short-circuit piece (230) located in a third plane and connecting with the radiating members, and a second short-circuit piece (220) connecting the first short-circuit piece with the third short-circuit piece and located in a second plane, with the first and third short-circuit pieces disposed on the same side of the second short-circuit piece. The radiating members comprises a first radiating member (110, 140) in the third plane and a second radiating member (120, 140) extending towards the first plane.

11 Claims, 6 Drawing Sheets

MULTI-BAND ANTENNA

BACKGROUND OF THE INVENTION

1. Field of the Invention

The present invention relates generally to a multi-band antenna, and more particularly to a multi-band antenna with single feeding point and multi radiating portions.

2. Description of the Prior Art

A present electric device, such as a notebook computer, always needs multi antennas for wireless communication. And in most designs, theses antennas are assembled in the inner space of the electric device. Thus, antennas used on different frequency bands are integrated together to reduce their volume.

US Patent Application Publication No. 2007/0040754 discloses an antenna structure integrating a first antenna of wireless wide area network (WWAN) and a second antenna of wireless local area network (WLAN), the same as U.S. Pat. No. 7,289,071, US Patent Application Publication No. 2007/0060222, US Patent Application Publication No. 2007/0096999. The two antennas respectively work as a single antenna but not influence to each other. However, some wireless communication criterions have common frequency band. For example, the center frequency under WLAN includes 2.4 GHz and 5 GHz and the frequency band under Worldwide Interoperability for Microwave Access (WiMax) includes 2.3-2.4 GHz, 2.5-2.7 GHz and 3.3-3.8 GHz, which overlaps the frequency bands under WLAN. Accordingly, an antenna integrated with a single WLAN antenna and a single WiMax antenna is not benefit for saving the inner space of the electric device.

Hence, in this art, a multi-band antenna to overcome the above-mentioned disadvantages of the prior art will be described in detail in the following embodiment.

BRIEF SUMMARY OF THE INVENTION

A primary object, therefore, of the present invention is to provide a multi-band antenna adapt to at least two types of network criterions.

In order to attain the object above, a multi-band antenna according to the present invention comprises a grounding portion, a plurality of radiating members and a short-circuit portion. The short-circuit portion comprises a first short-circuit piece connecting with the grounding portion and located in a first plane, a third short-circuit piece located in a third plane and connecting with the radiating members, and a second short-circuit piece connecting the first short-circuit piece with the third short-circuit piece and located in a second plane, with the first and third short-circuit pieces disposed on the same side of the second short-circuit piece. The radiating members comprises a first radiating member in the third plane and a second radiating member extending towards the first plane.

Other objects, advantages and novel features of the invention will become more apparent from the following detailed description of a preferred embodiment when taken in conjunction with the accompanying drawings.

DETAILED DESCRIPTION OF THE INVENTION

Figure 1:
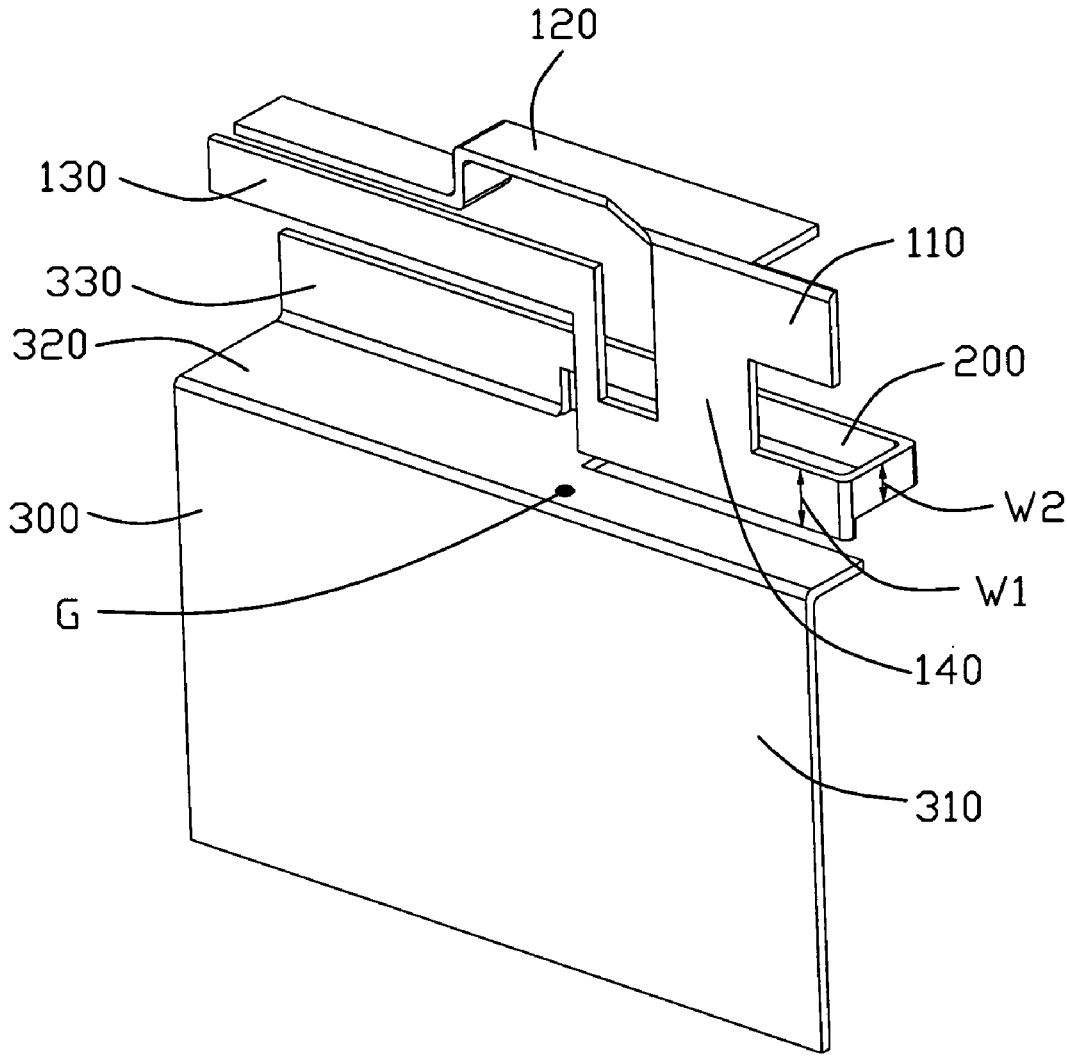
FIG. 1 is a perspective view illustrating a preferred embodiment of a multi-band antenna in according with the present invention.
Figure 2:
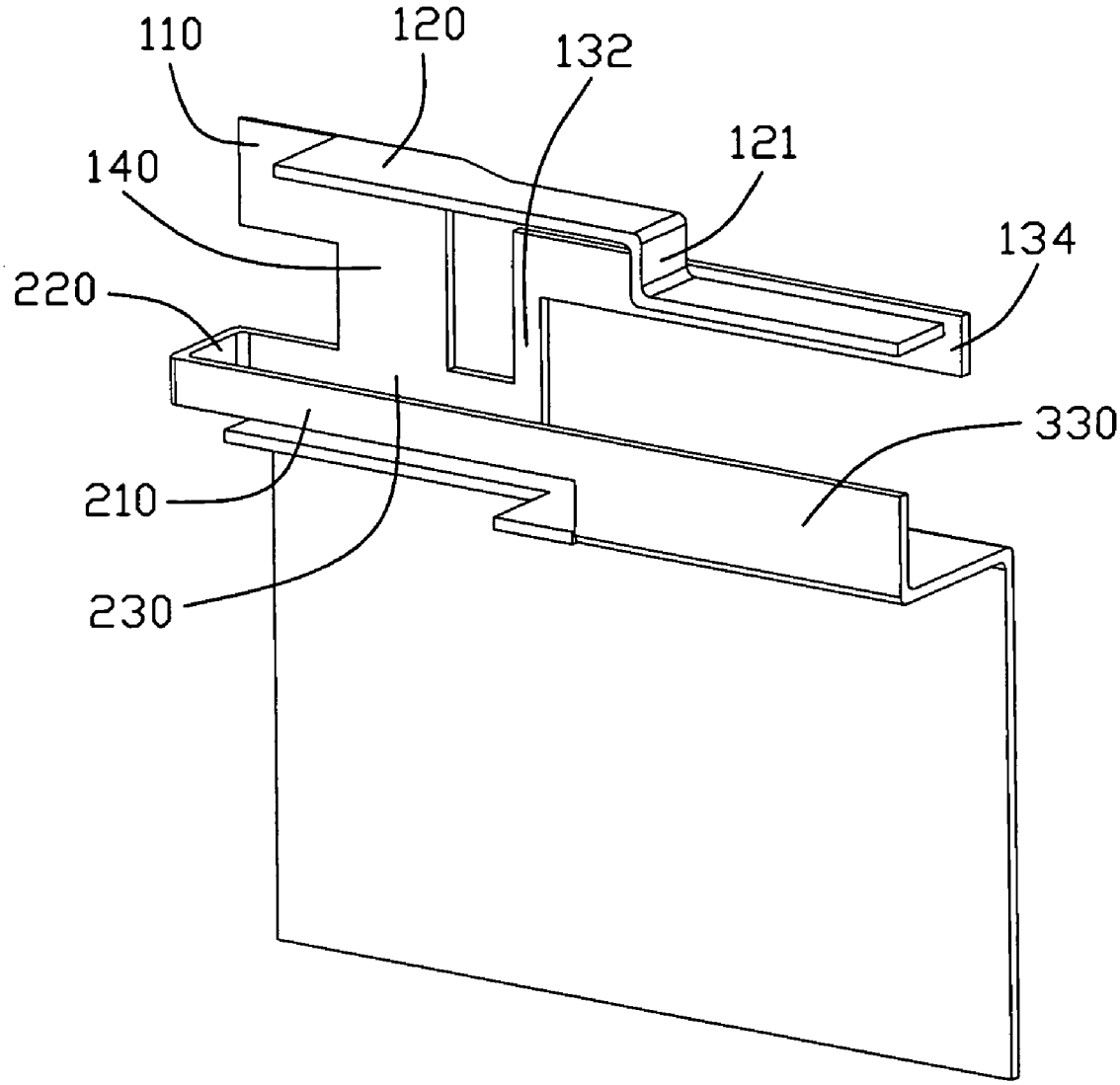
FIG. 2-5 are views similar to FIG. 1, but viewed from different aspects.
Figure 3:
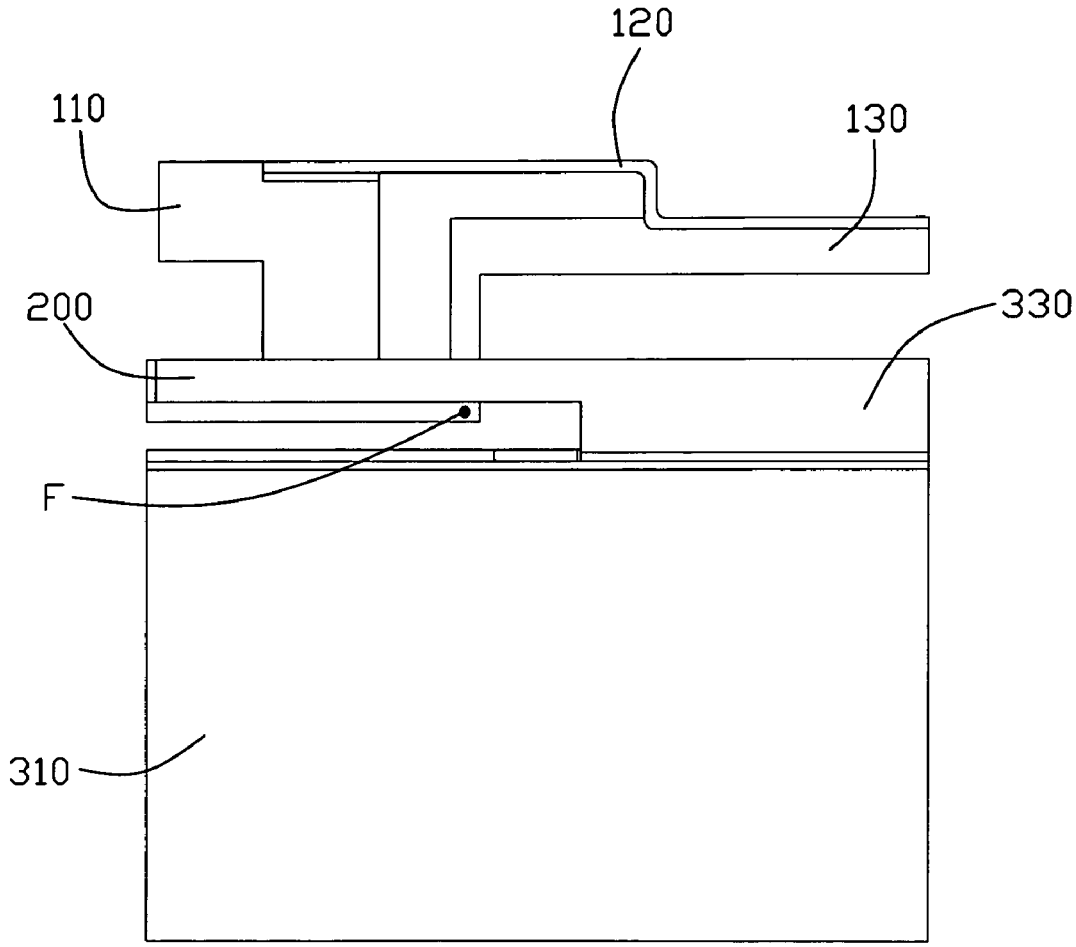
Figure 4:
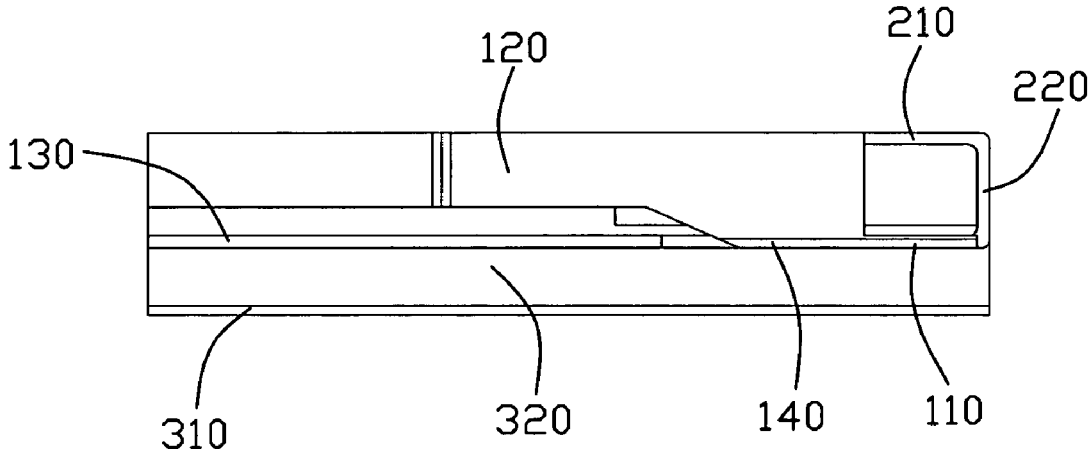
Figure 5:
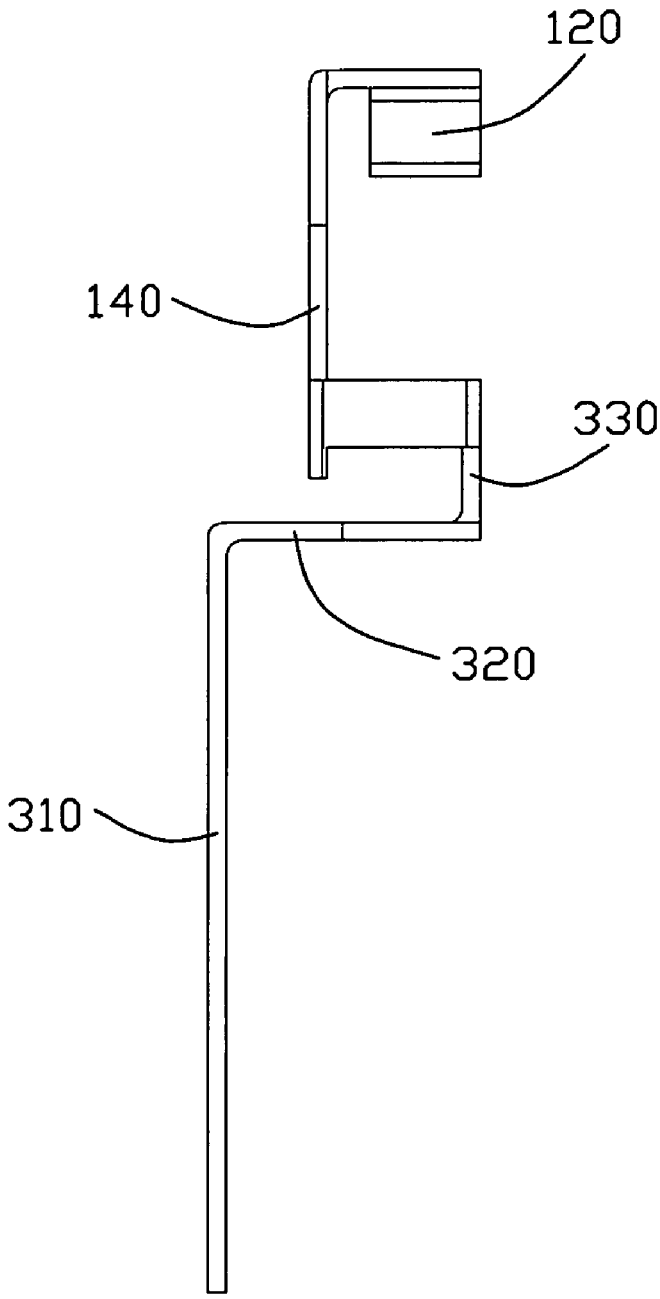

Reference will now be made in detail to a preferred embodiment of the present invention.

Please referring to FIGS. 1-5, a multi-band antenna according to the present invention is applied in a notebook, and comprises a grounding portion 300, a short-circuit portion 200 connecting with the grounding portion 300, and three radiating members extending from the short-circuit portion 200.

The grounding portion 300 is shaped like a step, and comprises a first grounding piece 310 located in a vertical plane, a second grounding piece 320 connecting with an end of the first grounding piece 310 and standing in a horizontal plane, and a third grounding piece 330 extending upwards from an end, which is far away from the first grounding piece 310, of the second grounding piece 320.

The short-circuit portion 200 is C-shaped, and comprises a first short-circuit piece 210 in the same plane with the third grounding piece 330 and connecting with the third grounding piece 330, a third short-circuit piece 230 running parallel to the first short-circuit piece 210, and a second short-circuit piece 220 connecting the first and third short-circuit pieces 210, 230. The third short-circuit piece 230 has a larger width W1 than the width W2 of the first and second short-circuit pieces 210, 220.

A common metal piece 140 extends upwards from a middle portion of the third short-circuit piece 230, and stands in a same plane with the third short-circuit piece 230. A first radiating piece 110 is rectangular, and extends rightwards from a top end of the common metal piece 140. The first radiating piece 110 and the common metal piece 140 are coplanar. A second radiating piece 120 extends leftwards and forwards from another top end of the common metal piece 140 so as to be generally parallel to the second grounding piece 320 and to be far away from the first radiating piece 110. The second radiating piece 120 is provided with a step portion 121 so as to lengthen the path of electricity.

A third radiating piece 130 extends from a free end of the third short-circuit piece 230, and is L-shaped. The third radiating piece 130, the first radiating piece 110 and the common metal piece 140 are coplanar. The third radiating piece 130 comprises a first portion 132 extending upwards from the free end of the third short-circuit piece 230, and a second portion 134 extending leftwards from the top of the first portion 132. The top of the second portion 134 is not higher than the bottom of the second radiating piece 120 in a vertical direction.

The first radiating piece 110 cooperates with the common metal piece 140 to receive and send signals at a first band width as a first radiating member. The second radiating piece 120 cooperates with the common metal piece 140 to receive and send signals at a second band width as a second radiating member. The third radiating piece 130 works at a third band width as a third radiating member.

The third short-circuit piece 230 forms a feeder F at free end thereof to connect with an inner conductor of a coaxial cable (not shown). The second grounding piece 320 has a grounding point G for connecting with an outer conductor of the coaxial cable.

Figure 6:
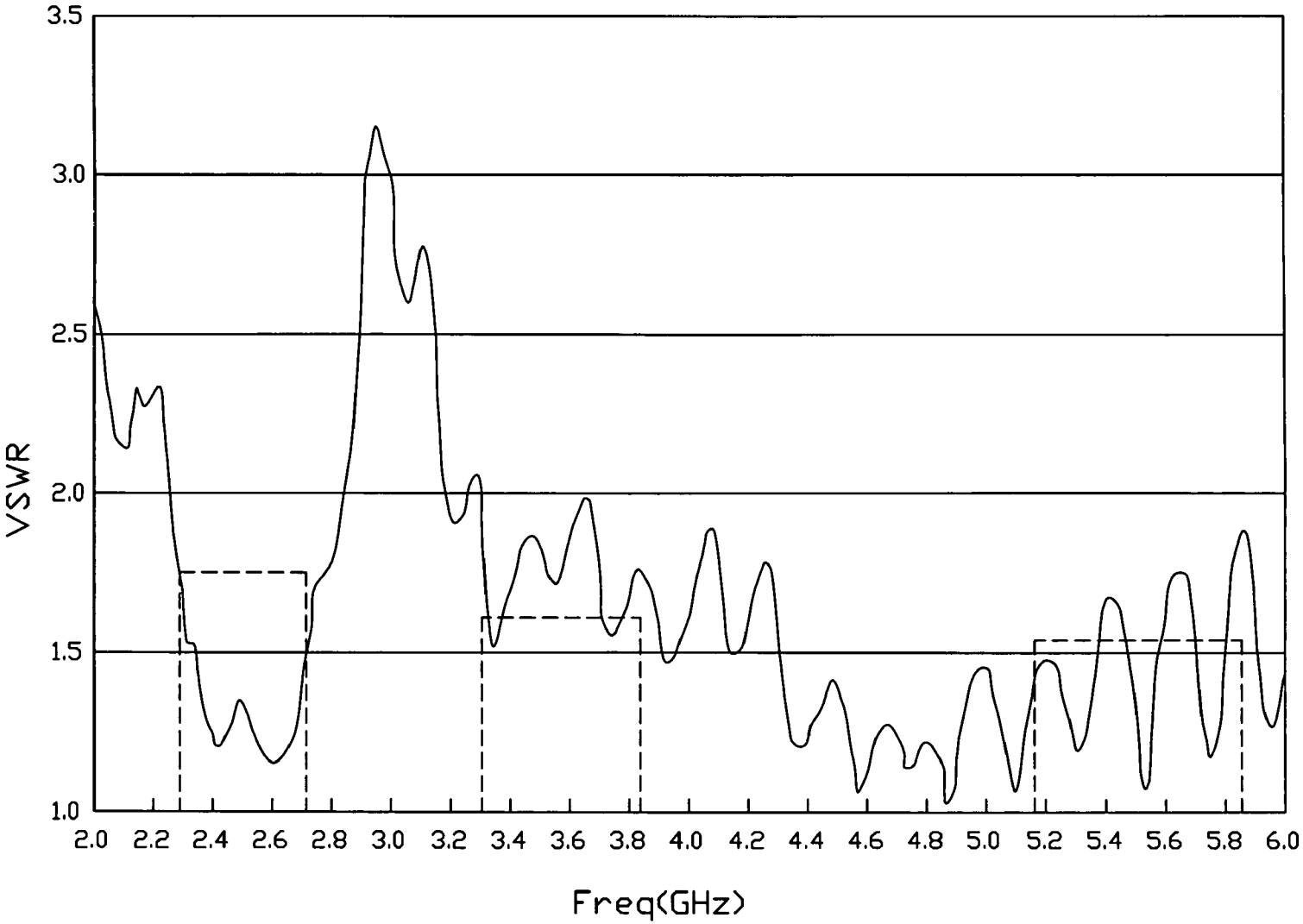
FIG. 6 is a test chart recording for the multi-band antenna of FIG. 1, showing Voltage Standing Wave Ratio (VSWR).

As shown in FIGS. 1-5, among the first, second and third pieces 110, 120, 130, the first radiating piece 110 has a largest width, and the first portion 132 has a smallest one. The common metal piece 140 has a large width, and in the common metal piece 140 there are many paths through which the electricity runs. So the first and second radiating members each have a bandwidth more than 400 MHz. FIG. 6 shows the VSWR view of the multi-band antenna. The first radiating member is adapted to receive and send signals on a higher frequency band of 5.15-5.85 GHz, the second radiating member works at a lower frequency band of 2.3-2.7 GHz, and the third radiating member resonates on a frequency band of 3.3-3.8 GHz; Thus, the multi-band antenna is obviously adapt to the requests of WLAN and WiMax.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A multi-band antenna comprising:

a grounding portion; and a short-circuit portion comprising a first short-circuit piece connecting with the grounding portion and located in a first plane, a third short-circuit piece located in a third plane and connecting with a plurality of radiating members, and a second short-circuit piece connecting the first short-circuit piece with the third short-circuit piece and located in a second plane, the first and third short-circuit pieces disposed on the same side of the second short-circuit piece;

said plurality of radiating members comprising a first radiating member in the third plane and a second radiating member extending towards the first plane, the first and second radiating members sharing a common metal piece which extends upwards from the third short-circuit piece.

2. The multi-band antenna as claimed in claim 1, wherein the grounding portion comprises a portion located in the first plane and connecting with the first short-circuit piece, and a second portion extending towards the third plane from the bottom of said portion of the grounding portion.

3. The multi-band antenna as claimed in claim 1, wherein the third short-circuit piece is provided with a feeder.

4. The multi-band antenna as claimed in claim 1, further comprising a third radiating member in the third plane.

5. The multi-band antenna as claimed in claim 1, further comprising a third radiating member extends upwards from the third short-circuit piece.

6. The multi-band antenna as claimed in claim 5, wherein said first radiating member works on a frequency band of 5.15-5.85 GHz, said second radiating member is used on a frequency band of 2.3-2.7 GHz and said third radiating member works on a frequency band of 3.3-3.8 GHz.

7. The multi-band antenna as claimed in claim 1, wherein the third short-circuit piece has a larger width than the first and second short-circuit pieces.

8. A multi-band antenna comprising:

a grounding portion;

a short-circuit portion connecting a radiating portion with the grounding portion;

the radiating portion comprising a common metal piece extending upwards from a portion of the short-circuit portion, a first radiating piece extending rightwards from the top of the common metal piece, a second radiating piece extending forwards and leftwards from the top of the common metal piece, a third radiating piece extending upwards and leftwards from another portion of the short-circuit portion, wherein the common metal piece, the first radiating piece and the third radiating piece are coplanar;

a feeder disposed on the short-circuit portion; wherein the short-circuit portion comprises a first short-circuit piece connecting with the grounding portion and located in a first plane, a third short-circuit piece located in the same plane with the common metal piece and connecting with the radiating portion, and a second short-circuit piece connecting the first short-circuit piece with the third short-circuit piece and located in a second plane, the first and third short-circuit pieces disposed on the same side of the second short-circuit piece.

9. The multi-band antenna as claimed in claim 8, wherein the second radiating piece is provided with a step portion so as to make the second radiating piece Z-shaped.

10. The multi-band antenna as claimed in claim 8, wherein the third short-circuit piece has a larger width than the first and second short-circuit pieces.

11. The multi-band antenna as claimed in claim 8, wherein the third short-circuit piece has a larger width than the first and second short-circuit pieces.

* * * * *